US006697591B2

(12) United States Patent
Morikawa et al.

(10) Patent No.: US 6,697,591 B2
(45) Date of Patent: Feb. 24, 2004

(54) ELECTROPHOTOGRAPHIC APPARATUS AND PROCESS CARTRIDGE

(75) Inventors: Yosuke Morikawa, Yokohama (JP); Kouichi Nakata, Numazu (JP); Kimihiro Yoshimura, Odawara (JP); Daisuke Tanaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/173,161

(22) Filed: Jun. 18, 2002

(65) Prior Publication Data

US 2003/0021612 A1 Jan. 30, 2003

(30) Foreign Application Priority Data

Jun. 21, 2001 (JP) ..... 2001-188619

(51) Int. Cl.[7] ..... G03G 15/00; G03G 15/02
(52) U.S. Cl. ..... 399/159; 399/175; 430/56
(58) Field of Search ..... 399/175, 159; 430/56, 58.05

(56) References Cited

U.S. PATENT DOCUMENTS

| | | | | |
|---|---|---|---|---|
| 4,380,384 A | | 4/1983 | Ueno et al. | |
| 4,851,960 A | | 7/1989 | Nakamura et al. | 361/225 |
| 5,681,679 A | | 10/1997 | Schank et al. | 430/59 |
| 5,747,207 A | | 5/1998 | Mashimo | 430/66 |
| 6,047,145 A | * | 4/2000 | Shigezaki et al. | |
| 6,163,670 A | * | 12/2000 | Gomi et al. | 399/175 |

FOREIGN PATENT DOCUMENTS

| | | |
|---|---|---|
| EP | 0 433 055 | 6/1991 |
| EP | 0 810 479 | 12/1997 |
| EP | 0 840 176 | 5/1998 |
| JP | 56-104351 | 8/1981 |
| JP | 57-178267 | 11/1982 |
| JP | 58-139156 | 8/1983 |
| JP | 58-150975 | 9/1983 |
| JP | 63-149668 | 6/1988 |
| JP | 58-40566 | 3/1993 |

* cited by examiner

*Primary Examiner*—Susan S. Y. Lee
(74) *Attorney, Agent, or Firm*—Fitzpatrick, Cella, Harper & Scinto

(57) ABSTRACT

An electrophotographic apparatus, includes: an electrophotographic photosensitive member and a charging device. The charging device includes a conductor particle-carrying member having an electroconductive and elastic surface, and conductor particles having a particle size of 10 nm–10 μm and carried on the carrying member so as to be disposed in contact with the photosensitive member, thereby directly injecting charges to the photosensitive member to charge the photosensitive member. The photosensitive member includes a photosensitive layer and a charge injection layer as a surface layer disposed in this order on a support, the charge-injection layer having a thickness d (μm) and an elastic deformation percentage We (OCL) (%) satisfying a relationship of formula (1) below with an elastic deformation percentage We (CTL) (%) of the photosensitive layer:

$$-0.71\times d+We(CTL)\leqq We(OCL)\leqq 0.03\times d^3-0.89\times d^2+8.43\times d+We(CTL) \quad (1).$$

15 Claims, 8 Drawing Sheets

ELECTROPHOTOGRAPHIC APPARATUS AND PROCESS CARTRIDGE

FIELD OF THE INVENTION AND RELATED ART

The present invention relates to an electrophotographic apparatus and a process cartridge, more particularly an electrophotographic apparatus and a process cartridge using a charging scheme wherein an electrophotographic photosensitive member is charged predominantly according to a charging mechanism whereby charges are directly injected into the photosensitive member surface from a charging member contacting the photosensitive member.

In an electrophotographic process, an electrophotographic photosensitive member comprising a photoconductor, such as selenium, cadmium sulfide, zinc oxide, amorphous silicon or an organic photoconductor is subjected to basic or unit processes, such as charging, exposure, development transfer and fixation, and in the charging process, a corona discharge phenomenon caused by applying a high voltage (on the order of DC 5–8 kV) to a metal wire has been conventionally used. According to the corona discharge scheme, however, corona discharge products, such as ozone and $NO_X$, denature the photosensitive member to result in blurring or deterioration of images, or soil the wire to adversely affect the image quality, thus resulting in white dropout or black streaks in images.

Particularly, in the case of an electrophotographic photosensitive member having a photosensitive layer principally comprising an organic photoconductor, which has a lower chemical stability than other photosensitive members, such as a selenium photosensitive member and an amorphous silicon photosensitive member, the organic photosensitive member and amorphous silicon photosensitive member, the organic photosensitive member is liable deteriorate due to chemical reactions, principally oxidation, when exposed to such corona discharge products. Accordingly, when used repetitively in the corona discharge charging scheme, the organic photosensitive member is liable to show a lower printing or copying life, due to the deterioration thereof leading to difficulties, such as image blurring, a lowering in sensitivity and a lower image density due to an increase in residual potential.

Further, the corona discharge charging scheme exhibits a lower charging efficiency as only 5–30% of electricity is utilized as a current flowing toward the photosensitive member and a major portion thereof is directed to a shield plate. For alleviating these problems, contact charging methods not utilizing a corona discharger have been studied, as proposed in JP-A 57-178267, JP-A 56-104351, JP-A 58-40566, JP-A 58-139156, JP-A 58-150975, etc. More specifically, in such a contact charging scheme, a charging member, such as an electroconductive elastic roller, supplied with DC voltage of ca. 1–2 kV from an external supply is caused to contact an electrophotographic photosensitive member, thereby charging the photosensitive surface to a prescribed potential.

The contact charging scheme is disadvantageous compared with the corona charging scheme, in respects of the non-uniformity of charge and the occurrence of dielectric breakdown of the photosensitive member, which result in, e.g., a charging irregularity in a streak shape of ca. 2–200 mm in length and ca. 0.25 mm or below in a direction perpendicular to the moving direction of the photosensitive member, leading to an image defect of a white streak (in a solid black or halftone image) in the normal development scheme or a black streak in the reversal development scheme.

For providing an improved charging uniformity to solve the above-mentioned problem, a method of superposing an AC voltage on a DC voltage and applying the superposed voltage to a charging member has been proposed (JP-A 63-149668). According to the charging method, an AC voltage (Vac) is superposed on a DC voltage (Vdc) to form a pulsating voltage for application, thereby effecting uniform charging.

By ensuring a charging uniformity to obviate image defects, such as white spots in the normal development scheme, or black spots or fog in the reversal developing scheme, according to the superposed voltage charging scheme, the superposed AC voltage is required to have a peak-to-peak potential difference (Vpp) of at least twice a discharge initiation voltage (Vth) according to the Paschen's law.

However, as the superposed AC voltage is increased in order to obviate the image defects, the maximum applied voltage of the pulsating voltage is increased, and a dielectric breakdown due to discharge is liable to occur even at a slight defect in the photosensitive member. Particularly, in the case of a photosensitive member comprising an organic photoconductor having a lower dielectric strength, the dielectric breakdown is liable to be caused. Similarly as in the DC charging scheme, if such a dielectric breakdown is caused, a white image dropout is caused in the normal development scheme and a black streak image defect is caused in the reversal development scheme, in a longitudinal contact direction (i.e., a lateral direction of a recording material).

Further, also in the DC-AC superposed contact charging scheme, the charging mechanism still relies on a discharge phenomenon across a minute gap, and discharge products, such as $NO_X$ or ozone, deteriorate the photosensitive member surface and result in attachment of low-resistivity materials onto the surface, leading to problems, such as image blurring. Further, as the charging member contacts the photosensitive member and the photosensitive member is exposed to a much higher electric field intensity than in the corona charging scheme, a surface layer of the photosensitive member is liable to peel off to result in a shorter life of the photosensitive member.

In order to solve the above-mentioned problems, there has been proposed a charging process wherein charges are directly injected into a photosensitive member without being substantially accompanied by a discharge phenomenon.

The charging scheme wherein direct charge injection to a photosensitive member (which may also be called "injection charging") is predominant is substantially different from the above-mentioned charging scheme wherein the discharge is predominant (which may also be called "discharge charging"). Some characteristics of the two charging schemes are described with reference to FIG. 1, which shows a relationship between DC applied voltages Vdc from a supply indicated on the abscissa and resultant surface potentials on an electrophotographic photosensitive member on the ordinate.

In the case of discharge charging, as shown in FIG. 1, discharge is initiated only after the voltage applied to the charging member has reached a discharge initiation voltage Vth, and an excess of the applied voltage over the discharge injection provides a surface potential on the photosensitive member. More specifically, in the case of discharge charging using only a DC voltage, a relationship according to the following formula (6) holds between the applied voltage Vdc and the resultant surface potential Vd on the electrophotographic photosensitive member:

$$|Vd| \div |Vdc| - |Vth| \quad (6).$$

In a typical case, Vth may be calculated according to the following formula based on the Paschen's law:

$$Vth = (8837.7 \times D)^{1/2} + 312 + 6.2 \times D,$$

wherein D=L/K, L is a thickness ($\mu$m) of a photosensitive layer, and K is a dielectric constant of the photosensitive layer.

On the other hand, in the case of injection charging, as shown in FIG. 1, a surface potential on an electrophotographic photosensitive member is nearly equal to a voltage applied to the charging member, and the absence of a threshold like the discharge initiation voltage in the case of discharge charging is a characteristic of this charging scheme. In other words, the satisfaction of a relationship according to the following formula (7) at least suggests the possibility of occurrence of injection charging:

$$|Vdc| - |Vd| < |Vth| \quad (7).$$

However, this condition alone does not exclude a case where a higher surface potential Vd is given to the photosensitive member due to triboelectrification. Further, based on a premise that the formula (6) represents discharge charging, in a case of the formula (7) where the value of (Vdc−Vd) is close to Vth, some extent of injection charging may occur but discharge charging is believed to be still predominant.

Accordingly, a charging scheme predominantly governed by discharge charging may be represented by the following formula (8):

$$|Vth/2| < |Vdc| - |Vd| < Vth \quad (8),$$

whereas a charging scheme predominantly governed by injection charging may be represented by the following formula (3):

$$|Vdc| - |Vc| \leqq |Vth/2| \quad (3).$$

The case of applying a superposition of a DC voltage Vdc (V) and an AC voltage Vac (V) is applied to an electrophotographic photosensitive member from a charging member is considered with reference to FIG. 2. The charging scheme is generally called an AC/DC-superposed scheme. If the peak-to-peak voltage of an AC voltage is denoted by Vpp (V), in the case of discharge charging wherein Vpp is set so as to satisfy the following formula (9), the surface potential provided to an electrophotographic photosensitive member may be represented by formula (10) below:

$$|Vpp| \geqq 2 \times |Vth| \quad (9)$$

$$|Vd| \div |Vdc| \quad (10).$$

Thus, in the case of AC/DC-superposed discharge charging, the voltage Vpp and Vdc applied to a primary charging member are determined so as to stabilize the charging performance.

However, in the case of a lower Vpp as represented by formula (11) below, the surface potential provided to an electrophotographic photosensitive member may be changed to a value as represented by formula (12) below:

$$|Vpp| < 2 \times |Vth| \quad (11)$$

$$|Vd| \div |Vpp/2| + |Vdc| - Vth| \quad (12).$$

In other words, if it is assumed that the DC voltage component Vdc (V) of the applied voltage and the discharge initiation voltage Vth (V) are constant, as the peak-to-peak voltage Vpp (V) of the AC voltage is gradually lowered, the surface potential Vd (V) provided to an electrophotographic photosensitive member is correspondingly lowered and when Vpp is 0, Vd becomes the same as in the DC charging scheme and the formula (12) is reduced to the formula (6). Further, if dark attenuation of potential on the photosensitive member is taken into account, formula (13) below may be more accurate than the formula (12):

$$|Vd| \leqq |Vpp/2| + |Vdc| - |Vth| \quad (13).$$

On the other hand, in the AC/DC-superposed charging scheme in case where the injection charging mechanism is predominant, the AC voltage plays only a supplementary role and a high Vpp is not used generally. Thus, only a level of Vpp according to the formula (11) is applied. The injection charging is remarkably different from the discharge charging in that in a charging system wherein the injection charging mode is predominant, the surface potential provided to the photosensitive member is still almost identical to the DC component voltage Vdc of the applied voltage from the charging member even at such a low Vpp level. The difference between the two charging schemes is clearly shown in FIG. 2. In other words, in the charging system wherein the injection charging is predominant, in addition to the holding of the formula (3), formula (14) also holds true instead of the formula (13):

$$|Vd| > |Vpp/2| + |Vdc| - |Vth| \quad (14).$$

As is understood from the above discussion, there is a clear difference in principle between the charging system wherein the injection charging is predominant (which may also be called a "injection charging-controlled charging system or scheme") and the discharge charging system regardless of whether they are operated in the pure DC-application mode or the AC/DC-superposed application mode.

In the injection charging-controlled charging scheme, discharge is not substantially caused as charges are directly into the photosensitive member, and accordingly, the occurrence of discharge products, such as $NO_X$ and Ozone, and deterioration of the photosensitive member therewith are substantially negligible, and little electrical damage is exerted to the photosensitive member, so that an ideal charging operation can be effected.

However, in order to effectively operate the injection charging scheme, the charging member is caused to contact the photosensitive member with a relative speed difference therebetween, and relatively hard charging particles are retained at a contact region between the charging member and the photosensitive member. Accordingly, in the injection charging-controlled charging system, the photosensitive member surface is liable to receive a large load and be damaged or scarred thereby. Further, an electrophotographic image-forming system including the charging scheme is liable to suffer from the difficulty of fog in continuous image formation in the high humidity environment peculiarly inherent to the charging system.

SUMMARY OF THE INVENTION

A principal object of the present invention is to provide an electrophotographic apparatus including an injection charging-controlled charging system, resistant to damages attributable to the charging system and capable of stably providing high-quality images free from fog peculiar to the charging system even after repetitive and continual image formation in a high humidity environment.

Another object of the present invention is to provide a process cartridge suitable for organizing such an electrophotographic apparatus.

According to the present invention, there is provided an electrophotographic apparatus, comprising: an electrophotographic photosensitive member and a charging means, wherein the charging means comprises a conductor particle-carrying member having an electroconductive and elastic surface, and conductor particles having a particle size of 10 nm–10 μm and carried on the carrying member so as to be disposed in contact with the photosensitive member, thereby directly injecting charges to the photosensitive member to charge the photosensitive member, and the photosensitive member comprises a photosensitive layer and a charge injection layer as a surface layer disposed in this order on a support, the charge-injection layer having a thickness d (μm) and an elastic deformation percentage We (OCL) (%) satisfying a relationship of formula (1) below with an elastic deformation percentage We (CTL) (%) of the photosensitive layer:

$$-0.71\times d+We(CTL)\leqq We(OCL)\leqq 0.03\times d^3-0.89\times d^2+8.43\times d+We(\mathrm{CTL}) \quad (1).$$

According to the present invention, there is also provided a process cartridge which includes the above-mentioned electrophotographic photosensitive member and charging means integrally supported to form a unit detachably mountable to an electrophotographic apparatus.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
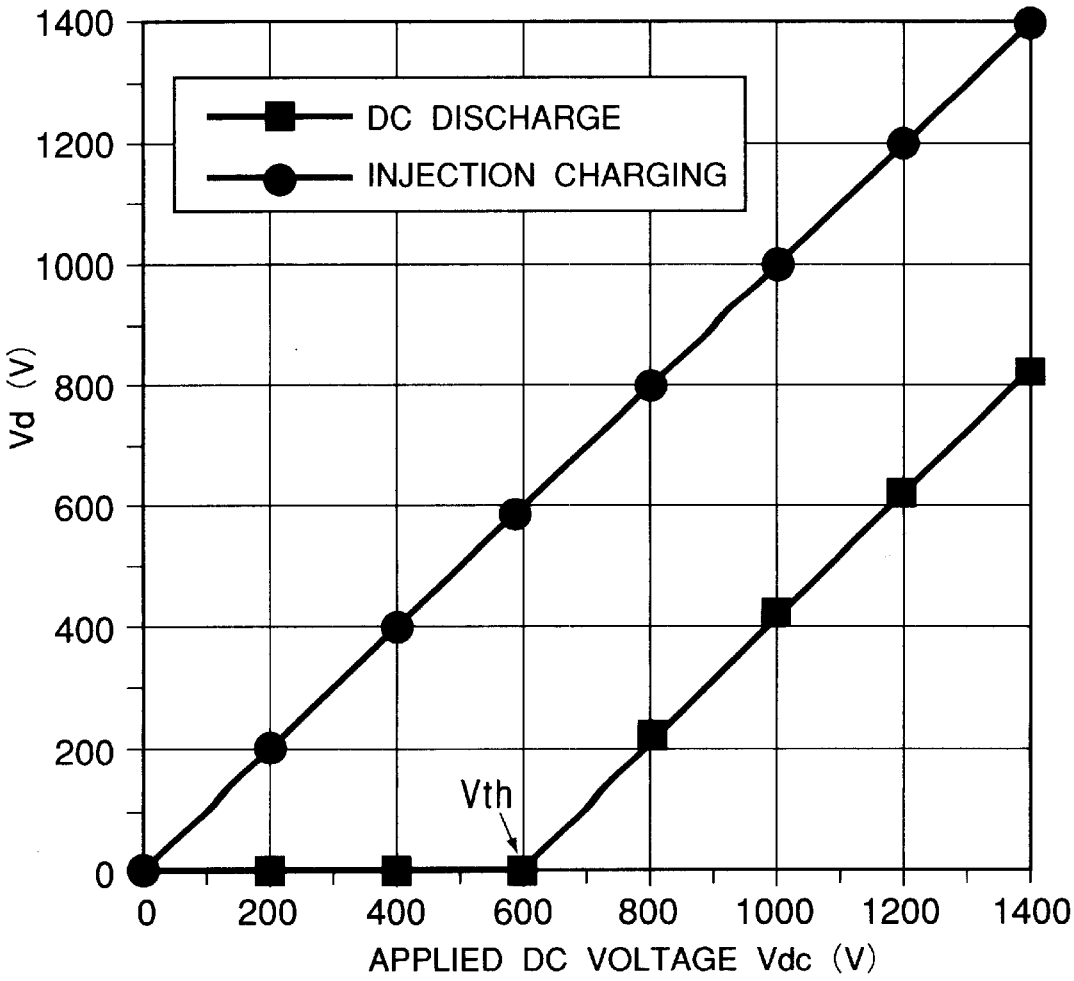
FIG. 1 is a graph showing relationships between surface potentials Vd of an electrophotographic photosensitive member and DC voltages Vdc applied to a charging member for illustrating a difference between discharge charging and injection charging according to a pure DC voltage application mode.
Figure 2:
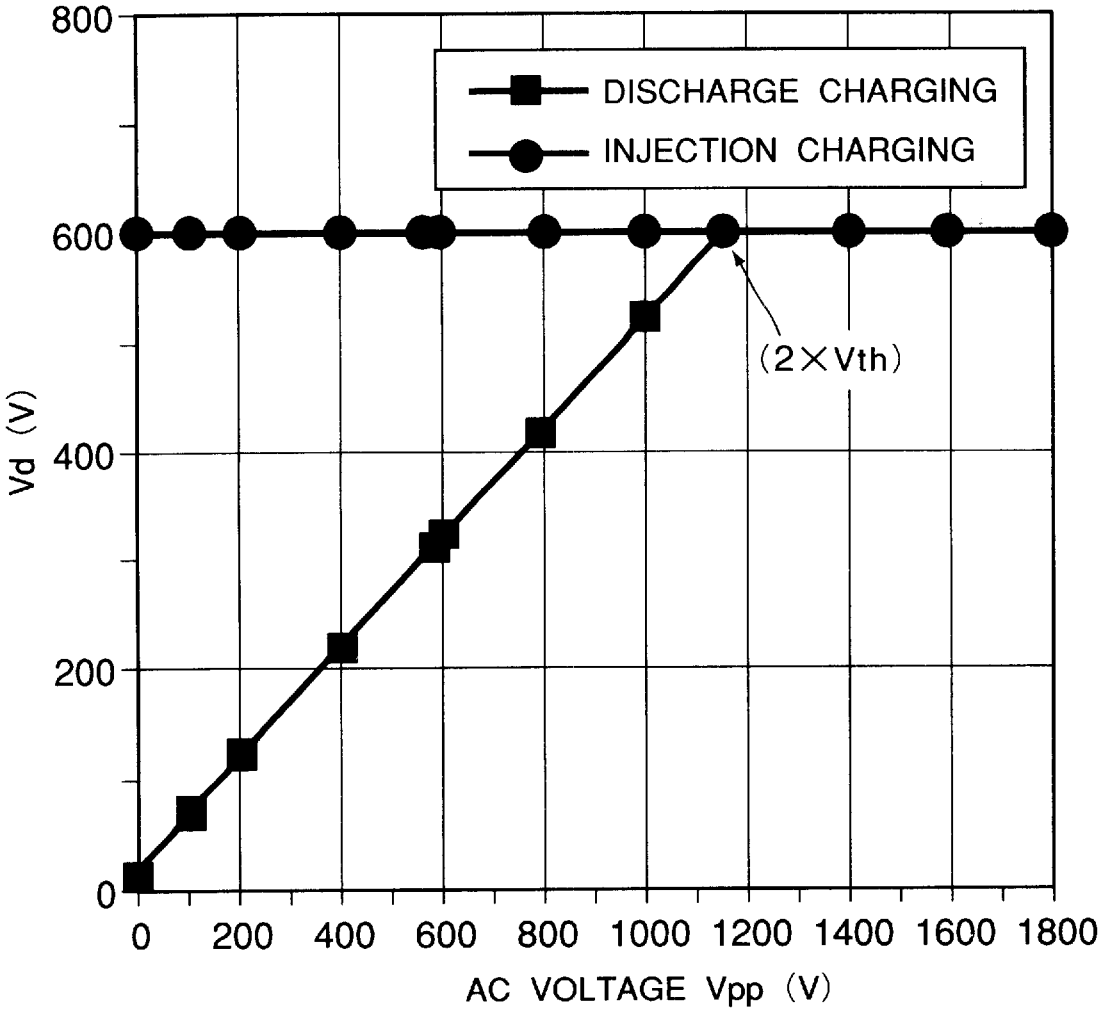
FIG. 2 is a graph showing relationships between surface potentials Vd of an electrophotographic photosensitive member and AC voltages Vpp applied to a charging member for illustrating a difference between discharge charging and injection charging according to an AC/DC-superposed voltage application mode.

The electrophotographic photosensitive member used in the present invention comprises a photosensitive layer and a charge-injection layer as a surface layer disposed in this order on a support, and the charge-injection layer has a thickness d (μm) and an elastic deformation percentage We (OCL) (%) satisfying a relationship of formula (1) below with an elastic deformation percentage We (CTL) (%) of the photosensitive layer:

$$-0.71\times d+We(CTL)\leqq We(OCL)\leqq 0.03\times d^3-0.89\times d^2+8.43\times d+We(\mathrm{CTL}) \quad (1)$$

It is preferred that d (μm), We(OCL) (%) and We(CTL) (%) further satisfy the following formula (2):

$$-0.71\times d+We(CTL)\leqq We(OCL)\leqq -0.247\times d_2+4.19\times d+We(CTL) \quad (2)$$

The elastic deformation percentage We (%) described herein is based on values measured by a hardness meter ("H100VP-HCU", made by Fischer K. K.; hereinafter called a "Fischer hardness meter") in an environment of 23° C./55% RH.

As different from the micro-Vickers method wherein a hardness is measured by pressing an indenter under a load onto a sample surface and then removing the indenter to measure a residual indentation depth through a microscope, according to the Fischer hardness meter, an indenter is continually pressed against a sample surface under varying loads and indentation depths under loads are directly and continually read to determine a hardness.

Figure 3:
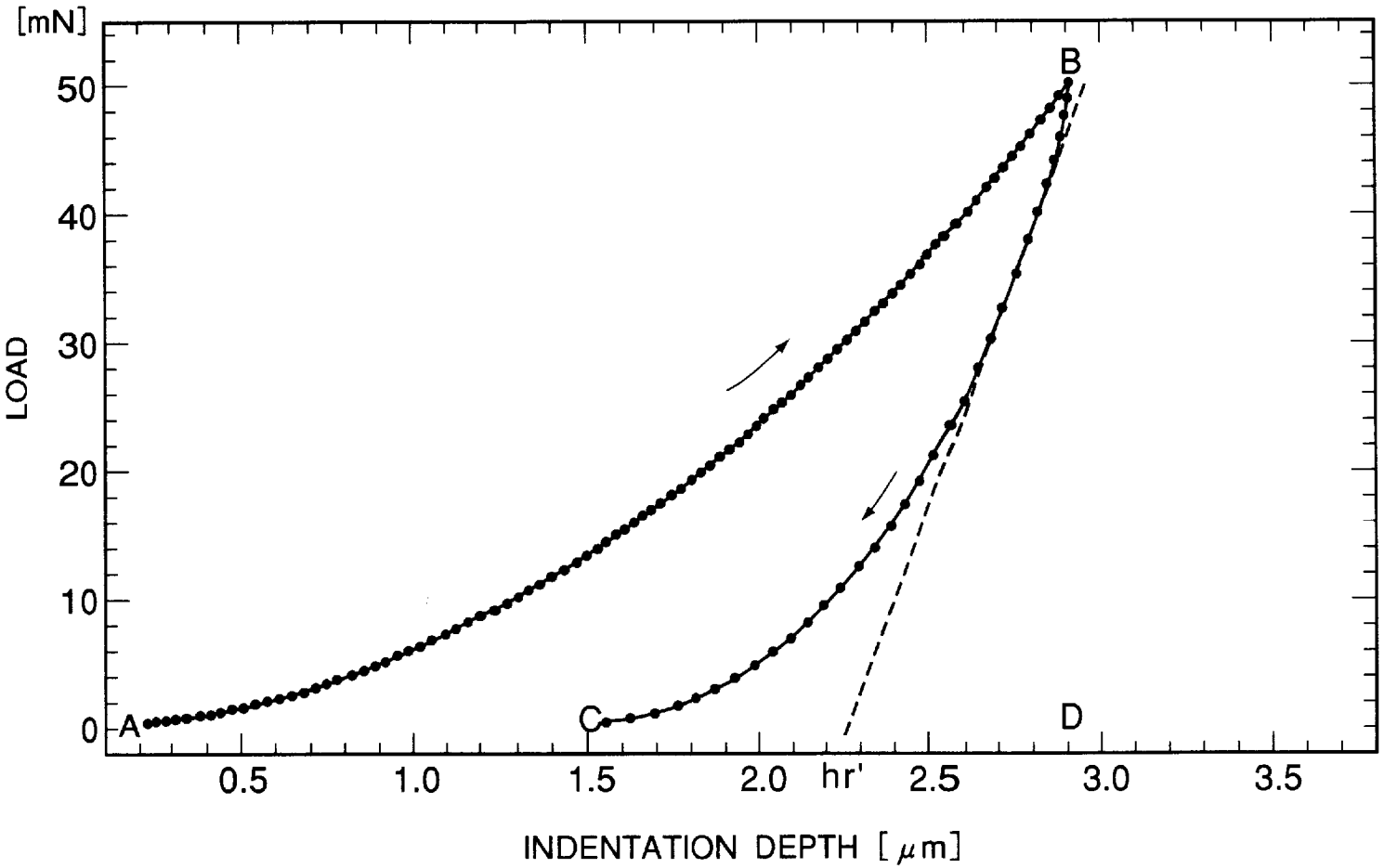
FIG. 3 shows an example of a load-indentation curve measured by a Fischer hardness meter.

More specifically, the elastic deformation percentage We (%) is measured as follows. A diamond indenter having a four-side pyramid tip forming a tip angle of 136 deg. between opposite sides is pressed against a sample surface under gradually increasing loads until the indentation depths as directly measured electrically reach 1 μm, and the indentation load is gradually decreased to 0. During the above process, the loads and the corresponding indentation depths are continually recorded. FIG. 3 shows plots of "indentation loads versus indentation depths" in a measurement example, wherein, however, the above-mentioned Fischer hardness meter measurement was applied to a 30 μm-thick coating film sample until the indentation depths reached ca. 3 μm (instead of 1 μm as generally adopted for defining the present invention) while varying the indentation loads along a route of A→B→C. Referring to FIG. 3, a work We (nJ) associated with elastic deformation is represented by an area enclosed by lines C-B-D-C, and a work Wr (nJ) associated with plastic deformation is represented by an area enclosed by lines A-B-C-A. Based on these values, the elastic deformation percentage We (%) is represented by the following equation (15):

$$We\ (\%)=\{We/(We+Wr)\}\times 100 \quad (15).$$

Generally, "elasticity" refers to a property of a solid material by which the solid material having received a strain (deformation) under the action of an external force tends to recover its original shape after removal of the external force. A portion of strain (deformation) remaining after the removal of the external force, because the external force exceeds the elastic limit of the material or because of other factors is a portion of plastic deformation. Thus, a larger value of elastic deformation percentage We (%) represents a larger proportion of elastic deformation, and a smaller value of elastic deformation percentage We (%) represents a larger proportion of plastic deformation.

Figure 4:
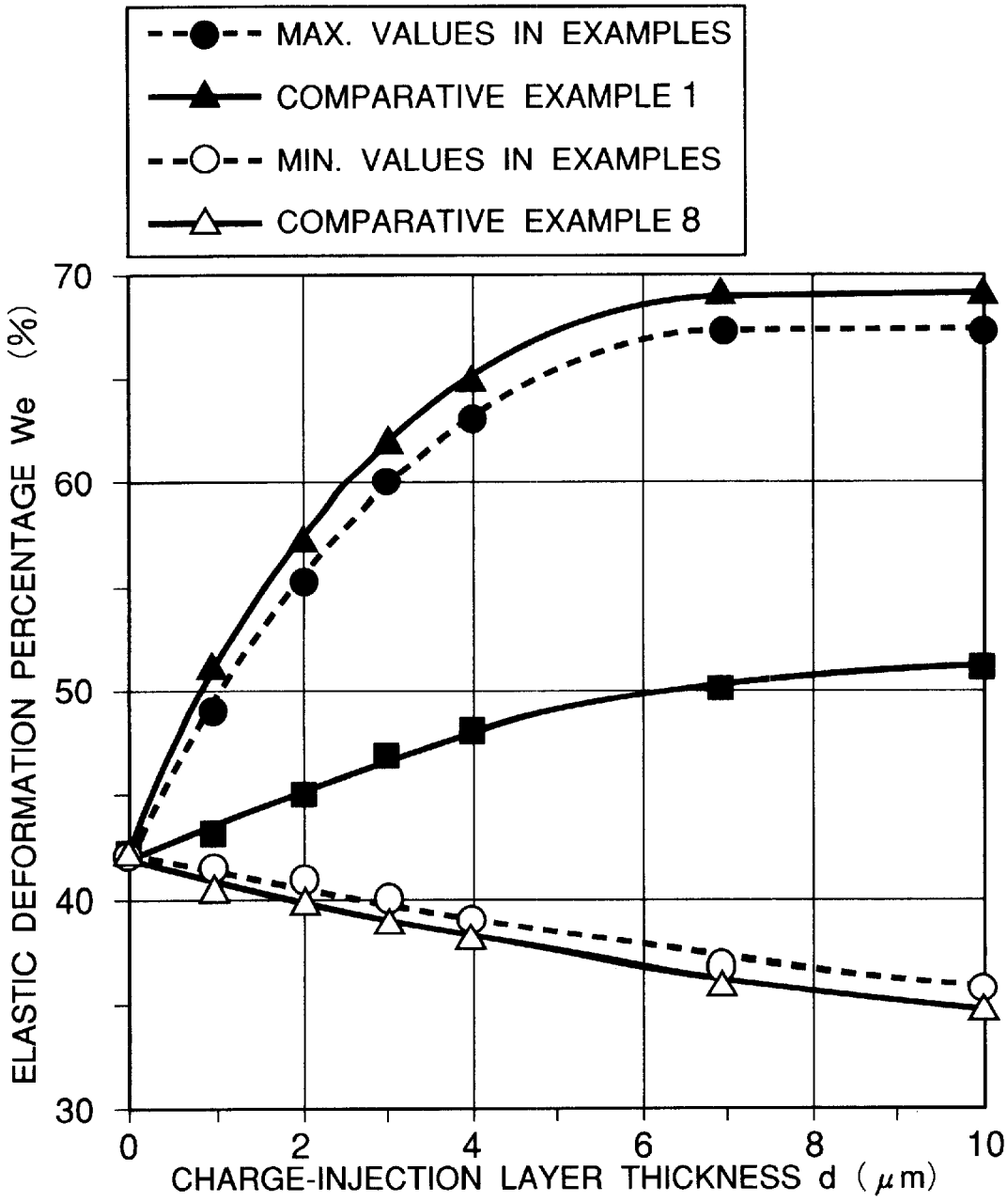
FIG. 4 shows plots of elastic deformation percentages We (OCL) (%) of the surface layer of photosensitive members versus charge-injection layer thicknesses d measured in Examples (including We (CTL) (%) at d=0).

Regarding the formula (1) for defining the elastic deformation characteristics of an electrophotographic photosensitive member having a charge-injection layer on a photosensitive layer, the elastic deformation percentage We (OCL) (%) is measured with respect to the charge-injection layer and the elastic deformation percentage We (CTL) (%) is measured with respect to the photosensitive layer after removing the charge-injection layer, respectively in the above-described manner by using a Fischer hardness meter. FIG. 4 summarizes values of We (OCL) (%) and We (CTL) (%) measured in the above-described manner with respect to Examples and Comparative Examples described hereinafter. As shown in FIG. 4, the values of We (OCL) (%) measured at varying thicknesses of the charge-injection layer(s) converged to the value of We (CTL) (%) shown at d=0 ($\mu$m) in FIG. 4 as the thickness d approached 0 ($\mu$m).

The left side of $\{-0.71\times d+We(CTL)\}$ in the formula (1) represents an approximated curve summarizing minimum values of We (OCL) (%) obtained in Examples and represents a linear function of thickness (d) based on values in the range of 1–8 $\mu$m. We (OCL) (%) values equal to or above this limit resulted in no problems, but the charge-injection layers characterized by We (OCL) (%) values below this limit were liable to be damaged because the charge-injection layers were rather brittle compared with the photosensitive layer.

The right side of $\{0.03\times d^3-0.89\times d^2+8.43\times d+We(CTL)\}$ in the formula (1) also represents an approximated curve summarizing maximum values of We (OCL) (%) obtained in Examples as We (OCL) (%) values not exceeding the above limit resulted in no problem, but We (OCL) (%) values exceeding the above limit resulted in fog during continuous image formation in a high humidity environment. This presumably large elastic deformation percentage is liable to cause local embedding of high-resistivity fine particles, such as paper dust or external additives to the toner, into the charge-injection layer, which results in local charge injection failure leading to fog. This difficulty is particularly noticeable in the case where conductive particles are present between an elastic carrying member and a photosensitive member and are liable to roughen the photosensitive member surface. This difficulty is also liable to be enhanced in the case where the conductor particle-carrying member is moved in a counter direction with respect to the photosensitive member surface at the contact position therebetween, where the photosensitive member surface is liable to be roughened. The reason why the difficulty is noticeably encountered in a high humidity environment may also be attributable to moisture absorption by paper dust or external additives of the toner in such a high humidity environment, but the true reason has not been clarified as yet.

In cases where the formula (2) of $We(OCL)\leqq\{-0.247\times d^2+4.19\times d+We(CTL)\}$ was further satisfied with respect to the right side, very good images completely free from fog as mentioned above were stably obtained.

In the present invention, it is preferred that the charge-injection layer contains electroconductive particles and lubricating particles.

Such electroconductive particles used in the charge-injection layer may comprise metals, metal oxides and carbon black, for example. Examples of the metal may include; aluminum, zinc, copper, chromium, nickel, silver and stainless steel. Plastic particles coated with a vapor-deposited layer of such metals may also be used. Examples of the metal oxide may include: zinc oxide, titanium oxide, tin oxide, antimony oxide, indium oxide, bismuth oxide, tin-doped indium oxide, antimony- or tantalum-doped tin oxide, and antimony-doped zirconium oxide. These electroconductive particles may be used alone or in combination of two or more species. The combination may be achieved by a simple mixture or in the form of solid solution or melt-sticked particles.

Among such electroconductive particles, it is particularly preferred to use those comprising a metal oxide in view of good transparency.

The electroconductive particles used in the charge-injection layer may preferably have a volume-average particle size of at most 0.3 $\mu$m, more preferably at most 0.1 $\mu$m, in view of the transparency of the charge-injection layer.

The lubricating particles used in the charge-injection layer may for example comprise fluorine-containing resin particles, silicon resin particles, silica particles and alumina particles. Fluorine-containing resin particles are particularly preferred. The fluorine-containing resin particles may for example comprise one or more species of fluorine-containing resins, such as tetrafluoroethylene resin, trifluorochloroethylene resin, hexafluoropropylene resin, vinyl fluoride resin, vinylidene fluoride resin, difluorodichloroethylene resin and copolymers of these resin species. Tetrafluoroethylene resin and vinylidene fluoride resin are particularly preferred. The molecular weight of the resin and the resin particle size may appropriately be selected without particular restriction.

Inorganic particles inclusive of the above-mentioned silica particles and alumina particles are not generally used as lubricating particles by themselves, but by adding and dispersing such inorganic particles into the charge-injection layer, the charge-injection layer may be provided with an increased surface roughness to allow a smooth movement of members contacting the photosensitive member surface due to a decreased number of contact points, thus consequently improving the lubricity of the charge-injection layer. The lubricating particles contemplated herein may include particles having a function of improving the lubricity of the charge-injection layer through such a function.

In order to prevent the aggregation of fluorine-containing resin particles as preferred lubricating particles in a coating liquid for forming the charge-injection layer, it is preferred to add a fluorine-containing compound. Further, in the case of incorporating the electroconductive particles, it is appropriate to add a fluorine-containing compound at the time of dispersing the electroconductive particles or surface-treat the electroconductive particles with a fluorine-containing compound prior to the dispersion. By the addition of or surface-treatment with a fluorine-containing compound, the dispersibility and dispersion stability of the electroconductive particles and the fluorine-containing resin particles in the coating resin solution for providing the charge-injection layer can be remarkably improved. Further, by dispersing the fluorine-containing resin particles into a liquid in which the electroconductive particles have been added together with or after surface-treatment with a fluorine-containing compound, a coating liquid free from aggregation into secondary particles and having very good dispersion stability with time, can be obtained.

The fluorine-containing compound suitably usable for the above purpose may be a fluorine-containing silane coupling agent, a fluorinated silicone oil or a fluorine-containing surfactant, examples of which may be enumerated hereinbelow. These are however not exhaustive.

[Fluorine-containing Silane Coupling Agents]

$CF_3CH_2CH_2Si(OCH_3)3$ $C_{10}F_{21}CH_2CH_2SCH_2CH_2Si(OCH_3)_3$ $C_4F_9CH_2CH_2Si(OCH_3)_3$ $C_6F_{13}CH_2CH_2Si(OCH_3)_3$ $C_8F_{17}CH_2CH_2Si\ (OCH_3)_3$ $C_8F_{17}CH_2CH_2Si(OCH_2CH_2CH_3)_3$ $C_{10}F_{21}Si(OCH_3)_3$ $C_6F_{13}CONHSi(OCH_3)_3$ $C_8F_{17}CONHSi(OCH_3)_3$ $C_7F_{15}CONHCH_2CH_2CH_2Si(OCH_3)_3$ $C_7F_{15}CONHCH_2CH_2CH_2Si(OCH_2CH_3)_3$ $C_7F_{15}COOCH_2CH_2CH_2Si(OCH_3)_3$ $C_7F_{15}COSCH_2CH_2CH_2Si(OCH_3)_3$ $C_7F_{15}SO_2NHCH_2CH_2CH_2Si(OCH_3)_3$

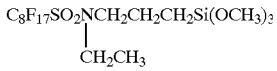

$C_8F_{17}CH_2CH_2SCH_2CH_2Si(OCH_3)_3$ $C_{10}F_{21}CH_2CH_2SCH_2CH_2Si(OCH_3)_3$

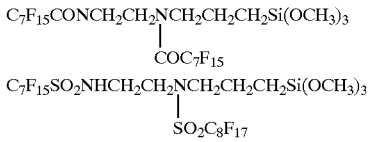

[Fluorinated Silicone Oil]

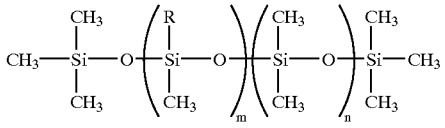

R: —$CH_2CH_2CF_3$, m & n: positive integer

[Fluorine-containing Surfactants]

X—$SO_2NRCH_2COOH$

X—$SO_2NRCH_2CH_2O(CH_2CH_2O)_nH$ (n=5, 10, 15)

X—$SO_2N(CH_2CH_2CH_2OH)_2$

X—$RO(CH_2CH_2O)_n$ (n=5, 10, 15)

X—$(RO)_n$ (n=5, 10, 15)

X—$(RO)_nR$ (n=5, 10, 15)

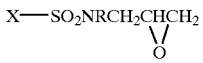

X—COOH, X—$CH_2CH_2COOH$

X—ORCOOH

X—$ORCH_2COOH$, X—$SO_3H$

X—$ORSO_3H$, X—$CH_2CH_2COOH$

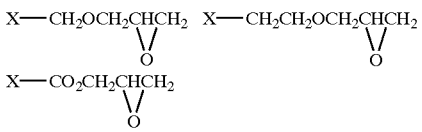

R: alkyl, aryl or aralkyl,

X: fluorocarbon group, such as —$CF_3$, —$C_4F_9$, or —$C_8F_{17}$.

For the surface treatment of the electroconductive particles, the electroconductive particles may be mixed and disposed together with a surface-treating agent (fluorine-containing compound) in an appropriate solvent so as to attach the surface-treating agent onto the electroconductive particles. For the dispersion, ordinary dispersion means such as a ball mill or a sand mill, may be used. Then, the solvent may be removed from the dispersion liquid to fix the surface-treating agent onto the electroconductive particles, optionally followed by a heat treatment. As desired, the electroconductive particles after the surface-treatment may be disintegrated or pulverized.

The fluorine-containing compound may be used so as to provide a surface treating amount of 1–65 wt. %, preferably 1–50 wt. %, based on the total weight of the surface-treated electroconductive particles.

As described above, by the dispersion of the electroconductive particles in a coating liquid after the addition of a fluorine-containing compound or after the surface-treatment with a fluorine-containing compound, it becomes possible to stabilize the dispersion of the fluorine-containing resin particles and provide a charge-injection layer with excellent slippability and releasability. However, in order to comply with a need for continuous image formation for providing a larger volume of documents in recent years, a charge-injection layer exhibiting a higher hardness and higher printing durability and stability, is being desired.

The binder resin for constituting the charge-injection layer suitably used in the present invention may preferably comprise a curable or cured resin, particularly one selected from acrylic resin, epoxy resin, polyurethane resin and siloxane resin. Among these, it is particularly preferred to use a phenolic resin in view of little change in resistivity of the resultant charge-injection layer in response to changes in environmental conditions. Further, in view of a high surface hardness, excellent wear resistance, and excellent dispersibility and excellent stability after dispersion of fine particles, it is further preferred to use a cured phenolic resin, particularly a thermosetting or thermally cured resole-type phenolic resin.

A resole-type phenolic resin is usually prepared through a reaction between a phenol compound and an aldehyde compound in the presence of a basic catalyst. Examples of the phenol compound may include: phenol, cresol, xylenol, para-alkylphenol, paraphenyl-phenol, resorcin and bisphenols, but these are not exhaustive. On the other hand, examples of the aldehyde compound may include: formaldehyde, para-formaldehyde, furfural and acetaldehyde, but these are not exhaustive.

Such a phenol compound and an aldehyde compound are reacted in the presence of a basic catalyst to provide resoles which are one or a mixture of monomers, such as monomethylolphenols, dimethylolphenols and trimethylolphenols, oligomers of these, and mixtures of monomers and oligomers. Among these, molecules having a single recurring unit are called monomers, and relatively large molecules having 2 to ca. 20 recurring units are called oligomers. The basic catalyst used for the resole formation may include: metal-based catalysts inclusive of alkali metal hydroxides and alkaline earth metal hydroxides, such as NaOH, KOH and $Ca(OH)_2$, and basic nitrogen compounds inclusive of ammonium and amines. In view of little resistivity change in a high-humidity environment of the resultant phenolic resin, it is preferred to use a basic nitrogen compound catalyst, particularly an amine catalyst in view of the stability of the coating liquid. Examples of the amine catalyst include: hexamethylenetetramine, trimethylamine, triethylamine and triethanolamine. These are however not exhaustive.

In the case of forming a charge-injection layer comprising a thermally cured resin, a coating liquid for the charge-injection layer applied on the photosensitive layer is ordinarily cured by heating, e.g., in a hot-air drying oven or furnace. At this time, the curing temperature may preferably be 100–300° C., particularly 120–200° C.

Incidentally, herein, the cured state of a resin is a state of the resin which is not soluble in an alcohol solvent, such as methanol or ethanol.

The charge-injection layer may preferably have a thickness within a range of 0.5 μm–10 μm, particularly 1 μm–7 μm.

The charge-injection layer can further contain another additive, such as an anti-oxidant.

The properties of the charge-injection layer defined by the present invention are affected by various factors inclusive of species of components forming the charge-injection layer, mixing ratios therebetween, particle sizes and dispersion state of particles contained therein, solid matter content before curing of the coating liquid, curing conditions, thickness, and further compositions of the photosensitive layer therebelow. However, in the present invention, the satisfaction of the above-mentioned properties is important, and specific means or measures for achieving the properties are not particularly restricted. As a general tendency, the elastic deformation percentage We (OCL) (%) tends to be larger, e.g., at a high curing temperature, a longer curing period, and a larger solid matter content, a lower resin content in the solid matter and a lower boiling point of the solvent in the coating liquid.

Next, the organization of the photosensitive layer will be described.

The photosensitive member of the present invention has a laminate structure including at least an electroconductive support and a photosensitive layer and a charge-injection layer disposed in this order on the support, and the photosensitive layer can be functionally separated into a charge generation layer and a charge transport layer.

Figure 5A:
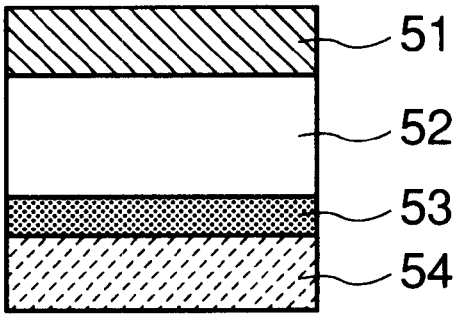
FIGS. 5A–5C show three laminate structures of photosensitive members.
Figure 5B:
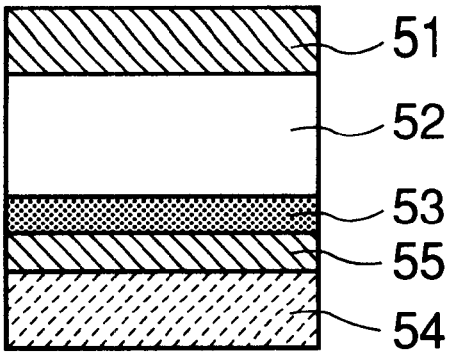
Figure 5C:
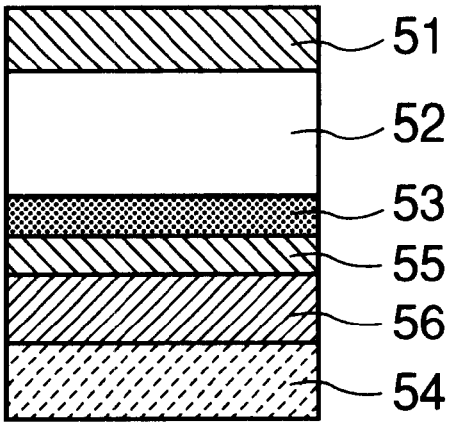

FIGS. 5A–5C show three embodiments of laminate structure of the electrophotographic photosensitive member each including such a laminate-type photosensitive layer. More specifically, the electrophotographic photosensitive member shown in FIG. 5A includes an electroconductive support 54, and a charge generation layer 53 and a charge transport layer 52 successively disposed thereon, and further a protective layer 51 as the surfacemost layer. As shown in FIGS. 5B and 5C, the photosensitive member can further include an undercoating layer 55, and further an electroconductive layer 56 for the purpose of, e.g., preventing the occurrence of interference fringes.

The electroconductive support 54 may be composed of a material which per se shows electroconductivity, such as aluminum, aluminum alloy or stainless steel; such an electroconductive support or a plastic support coated with a vapor deposition layer of aluminum, aluminum alloy or indium oxide-tin oxide campsite; a support comprising plastic or paper impregnated with electroconductive fine particles, such as carbon black, and fine particles of tin oxide, titanium oxide, and silver, together with an appropriate binder resin; or a shaped support comprising an electroconductive resin.

The undercoating layer 55 having a barrier function and an adhesive function may be disposed between the electroconductive layer 54 and the photosensitive layer (52 and 53). More specifically, the undercoating layer 55 is inserted for the purpose of improving the adhesion of the photosensitive layer thereon, improving the applicability of the photosensitive layer, protecting the support, coating defects on the support, improving the charge injection from the support, and protecting the photosensitive layer from electrical breakdown.

The undercoating layer 55 may be formed of, e.g., casein, polyvinyl alcohol. ethyl cellulose, ethylene-acrylic acid copolymer, polyamide, modified polyamide, polyurethane, gelatin or aluminum oxide. The undercoating layer 55 may preferably have a thickness of at most 5 μm, particularly 0.2–3 μm.

Examples of the charge-generating material constituting the charge generation layer 53 may include: phthalocyanine pigments, azo pigments, indigo pigments, polycyclic quinone pigments, perylene pigments, quinacridone pigments, azulenium salt pigments, pyrylium dyes, thiopyrylium dyes, squarylium dyes, cyanine dyes, xanthene dyes, quinoneimine dyes, triphenylmethane dyes, styryl dyes, selenium, selenium-tellurium, amorphous silicon, cadmium sulfide and zinc oxide. These are however not exhaustive.

The solvent for forming a paint for forming the charge generation layer 53 may be selected depending on the solubility and dispersion stability of the resin and charge-generating material used, e.g., from organic solvents, such as alcohols, sulfoxides, ketones, ethers, esters, aliphatic halogenated hydrocarbons and aromatic compounds.

The charge generation layer 53 may be formed by dispersing and mixing the charge-generating material together with 0.3–4 times by weight thereof of the binder resin and a solvent by means of a homogenizer, an ultrasonic disperser, a ball mill, a sand mill, an attritor or a roll mill to form a coating liquid, which is then applied and dried to form the charge generation layer 53. The thickness may preferably be at most 5 μm, particularly in a range of 0.01–1 μm.

The charge-transporting material may be selected from, e.g., hydrazone compounds, pyrazoline compounds, styryl compounds, oxazole compounds, thiazole compounds, triarylmethane compounds and polyarylalkane compounds. These are however not exhaustive.

The charge transport layer 2 may generally be formed by dissolving the charge transporting material and the binder resin in a solvent to form a coating liquid, followed by application and drying of the coating liquid. The charge-transporting material and the binder resin may be blended in a weight ratio of ca. 2:1 to 1:2. Examples of the solvent may include: ketones, such as acetone and methyl ethyl ketone, aromatic hydrocarbons, such as toluene and xylene, and chlorinated hydrocarbons, such as chlorobenzene, chloroform and carbon tetrachloride.

Examples of the binder resin for forming the charge transport layer 52 may include: acrylic resin, styrene resin, polyester resin, polycarbonate resin, polyarylate resin, polysulfone resin, polyphenylene oxide resin, epoxy resin, polyurethane resin, alkyd resin and unsaturated resin. Particularly preferred examples thereof may include: polymethyl methacrylate resin, polystyrene, styrene-acrylonitrile copolymer, polycarbonate resin and polyarylate resin. The charge transport layer 53 may have a thickens of 5–40 μm, preferably 10–30 μm.

The charge generation layer 53 or the charge transport layer 52 can further contain various additives, such as an antioxidant, and ultraviolet absorber, and a lubricant.

For application of the coating liquid for providing the above-mentioned layers, it is possible to use a coating method, such as dip coating, spray coating or spinner coating. The drying may be performed at a temperature of 10–200° C., preferably 20–150° C., for a period of 5 min. to 5 hours, preferably 10 min. to 2 hours, under air blowing or standing.

In the present invention, the above-mentioned charge-injection layer 51 may be formed by application and curing of the coating liquid therefor on the charge transport layer 52. Alternatively, it is possible to form the charge transport layer 52, the charge generation layer 53 and the charge-injection layer 51 in this order. It is further possible to form such a charge-injection layer on a single-layered photosensitive layer containing both the charge-generating material and the charge-transporting material.

Next, some description will be provided on the process cartridge and the electrophotographic apparatus according to the present invention.

Figure 6:
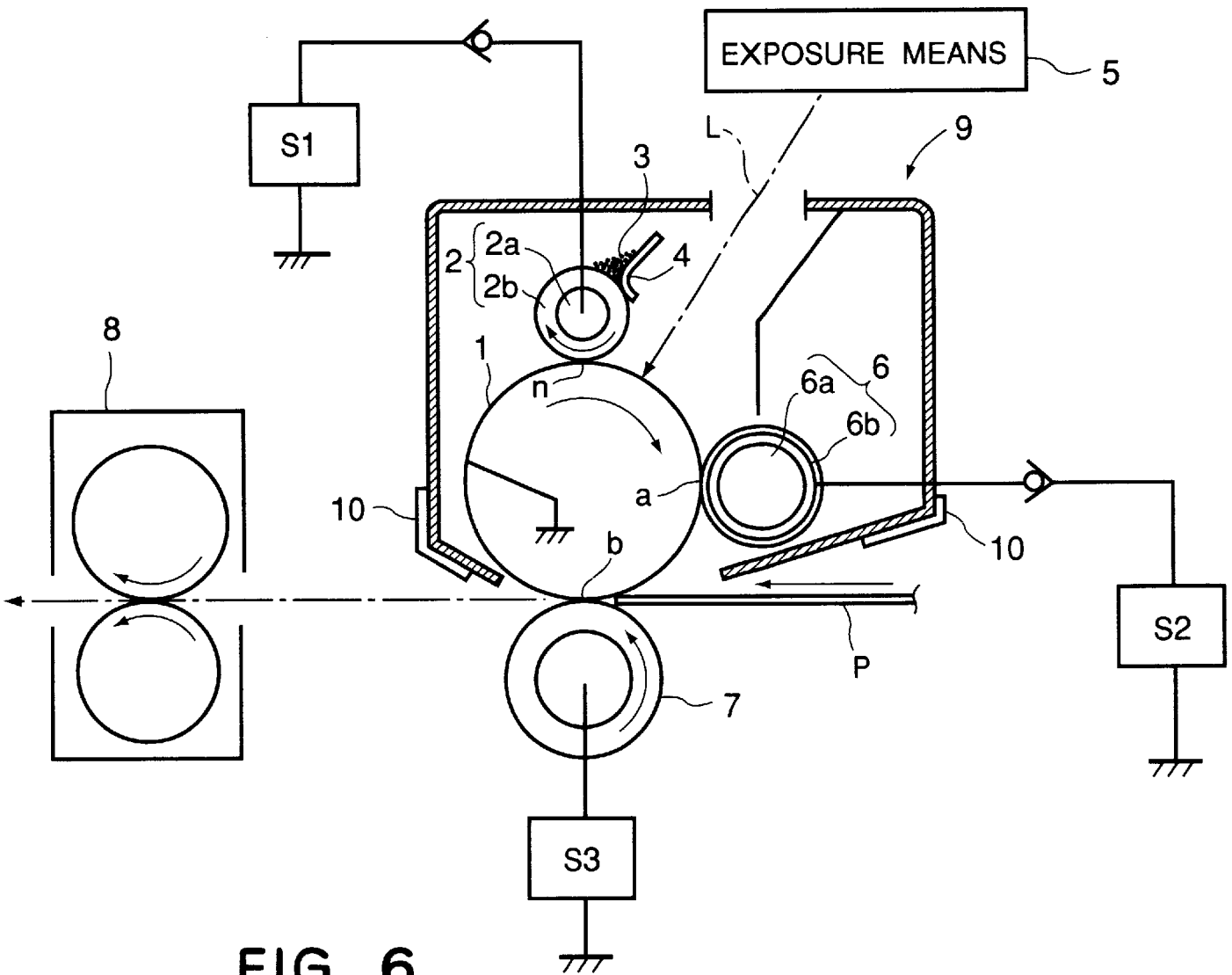
FIG. 6 schematically illustrates an organization of an electrophotographic apparatus according to Example 1.

FIG. 6 shows a schematic structural view of an electrophotographic apparatus including a process cartridge of the invention. Referring to FIG. 6, the apparatus includes a drum-shaped photosensitive member 1, and a primary charging member 2, an exposure means 5, a developing means 6 and a transfer means 7 disposed in this order so as to surround the photosensitive member 1.

First, the photosensitive member 1 rotated in an indicated arrow direction is surface-charged by applying a voltage from a voltage source S1 to the primary charging member 2 rotated in a counter-clockwise direction and in contact with the photosensitive member 1 and then exposed to light L carrying image data based on an original from the exposure means 5 to form an electrostatic latent image on the photosensitive member 1. Then, the electrostatic latent image on the photosensitive member is developed (visualized) as a toner image by attaching a toner from the developing means 6 to the photosensitive member 1 at a developing position a. The developing means 6 includes a rotating developing sleeve 6*b* and a magnet roll 6*a* enclosed therein, and a developing bias voltage is applied to the sleeve 6*b* from a voltage source S2. The thus-formed toner image on the photosensitive member 1 is then transferred onto a transfer material P, such as paper, supplied to a transfer position b, under the action of the transfer means 7 receiving a transfer bias voltage from a voltage source S3. Transfer residual toner remaining on the photosensitive member 1 without being transferred to the transfer material P can be recovered by means of a cleaner (not shown). In some embodiment, such transfer residual toner may be designed to be directly recovered by the developing means 6. As desired, the photosensitive member can be subjected to pre-exposure for charge removal by a pre-exposure means (not shown) which can be however omitted.

The toner image transferred onto the transfer material P is fixed onto the transfer material by fixing means 8.

In the electrophotographic apparatus (image forming apparatus) of FIG. 6, the exposure means 5 may include a light source, such as a halogen lamp, a fluorescent lamp, a laser or an LED, and can include an auxiliary process means, such as a beam scanner.

In the present invention, a plurality of the above-mentioned components, inclusive of the photosensitive member 1, the primary charging member 2, the developing means 6 and the cleaning means, may be integrally combined to form a process cartridge of the present invention, which is detachably mountable to a main assembly of the electrophotographic apparatus operated as a copying machine or a printer. For example, at least one of the primary charging member 2, the developing means 6 and the cleaning means can be integrally supported to form a process cartridge 9 which can be inserted to or released from the apparatus by guide means, such as rails 19 provided to the main assembly of the apparatus.

In the case where the electrophotographic apparatus is used as a copying machine or a printer, for example, the imagewise exposure light L may be provided as reflected light or transmitted light from an original, or signal light obtained by reading an original by a sensor, converting the read data into signals, and scanning a laser beam or driving a light-emitting device, such as an LED array or a liquid crystal shutter array, based on the signals.

Figure 7:
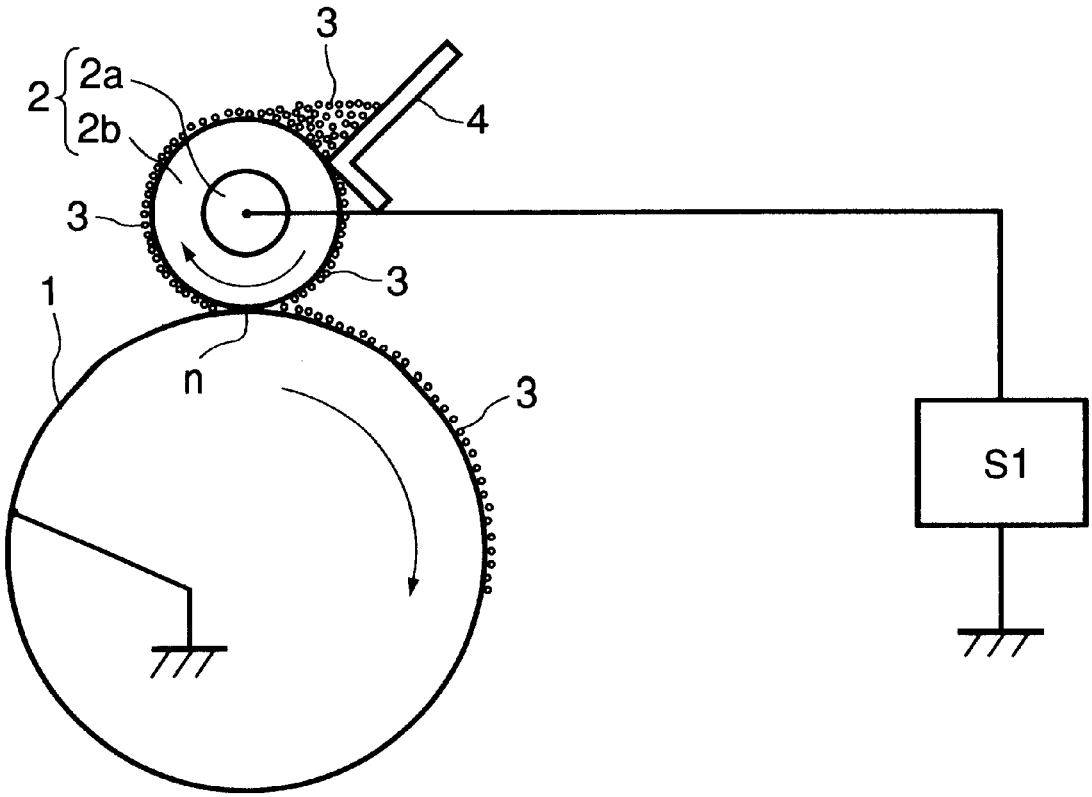
FIG. 7 illustrate some detail of the charging means in the apparatus of Example 1.

The embodiment of the electrophotographic apparatus shown in FIG. 6 includes the charging means (which is enlarged in FIG. 7). Referring to FIGS. 6 and 7. The charging means includes an electroconductive elastic roller (hereinafter sometimes called a "charging roller") 2, conductor particles (or charging particles) 3 for promoting the charging performance, and a regulating member 4 as a conductor particle-supply means. The photosensitive member is charged in a state where conductive particles 3 are applied at a contact position n between the charging roller 2 and the photosensitive member 1. As a result, the charging roller 2 and the photosensitive member 1 are allowed to contact each other with a speed difference therebetween, and charges are directly injected densely to the photosensitive member 1 via the conductive particles. Thus, according to the present invention, a much higher charging efficiency not attainably by the conventional roller charging mode can be achieved, and a potential almost identical to that applied to the charging roller 2 can be imparted to the photosensitive member 1.

The respective components of the charging means are described in further detail below, while referring to some experimental features used in a specific example also adopted in Examples described hereinafter.

<Charging Roller>

The charging roller 2 is prepared by coating a core metal 2*a* with a medium resistivity layer 2*b* of a resilient material, such as rubber or foam, for example, with a mixture of a resin (e.g., urethane resin), electroconductive particles (e.g., carbon black), a vulcanizing agent and a foaming agent, optionally followed by surface polishing, to provide an electroconductive elastic roller of 12 mm in diameter and 250 mm in length, in a specific example.

The roller 2 in a specific example exhibited a resistance of $10^5$ ohm as measured in a state where the roller 2 was pressed against a 30 mm-dia. aluminum drum so as to apply a total load of 1 kg to the core metal 2*a* and a voltage of 100 volts was applied between the core metal 2*a* and the aluminum drum.

It is important for the electroconductive elastic roller 2 to function as an electrode. Thus, the roller 2 is required to have a resilience so as to be in sufficient contact with the photosensitive member 1 and also a sufficiently low resistance so as to charge the rotating photosensitive member 1. It is also necessary to prevent a voltage leakage even when a defect, such as a pinhole, is present on the photosensitive member surface. In order to attain sufficient charging performance and leakage resistance, it is preferred that the charging roller 2 exhibits a resistance of $10^{4-107}$ ohm.

As for the hardness of the charging roller 2, too low a hardness obstructs the shape stability thus resulting in a poor contact with the photosensitive member, and too high a hardness fails in ensuring a charging nip with the photosensitive member and results in a poor microscopic contact with the photosensitive member surface, so that a hardness (Asker C hardness) in a range of 25 deg. to 50 deg. is preferred.

The material of the charging roller 2 is not restricted to an elastic foam body, but other elastic materials may also be used, inclusive of a rubbery material, such as EPDM, urethane rubber, NBR, silicon rubber or isoprene rubber, with an electroconductive material, such as carbon black or metal oxides, dispersed therein, and foamed products of these elastic materials. Further, it is also possible to adjust the resistivity by using an ionically conductive material and without dispersing an electroconductive material.

The charging member is not restricted to such a charging roller but can be another elastic member, such as a fur brush comprising fiber piles having a resilience. In a specific example, a fur brush roller was prepared by planting resistivity-adjusted fiber piles (e.g., "REC", made by Unitika K. K.) at a plant density of 155 piles/mm and a pile length of 3 mm to form a pile tape and winding the pile tape about a 6 mm-dia. core metal to form a roller.

<Charging Particles>

In a specific example, electroconductive zinc oxide particles having a resistivity of $10^6$ ohm.cm and an average particle size of 3 $\mu$m were used as the charging or conductor particles.

As for materials of the conductor particles, however, it is also possible to use electroconductive inorganic particles, such as other metal oxide particles, or a mixture with an organic material.

In order to achieve charge transfer via the particles, the charging particles may preferably have a resistivity of at most $10^{10}$ ohm.cm. The resistivity values described herein are based on values measured according to the tablet method wherein 0.5 g of a powdery sample is placed on a lower electrode in a cylinder having a sectional area of 2.26 $cm^2$ (=S) and supplied with a pressure of 15 kg between the lower electrode and an upper electrode placed thereon to measure a resistance (R ohm) under application of 100 volts. From the measured value, the resistivity (Rs) is calculated as a normalized value, i.e., according to the formula of $Rs=R\times S/H$, wherein H is a distance between the upper and lower electrodes.

It is generally preferred that the charging particles have a particle size of 10 nm–10 $\mu$m. It is difficult to obtain particles of below 10 nm stably. On the other hand, above 10 $\mu$m, it becomes difficult to inject charges at a sufficiently high density to the photosensitive member, thus failing to provide a good charging uniformity.

The average particle size of the charging particles described herein are based on values measured by taking at least 100 particles (inclusive of agglomerates as such) on optical-microscopic or electromicroscopic photographs thereof and measuring the particle size (longer axis diameter in horizontal direction) thereof to derive a volume-basis particle size distribution, from which the average particle size is determined as a particle size giving an accumulative volume of 50% on the distribution.

Figure 8:
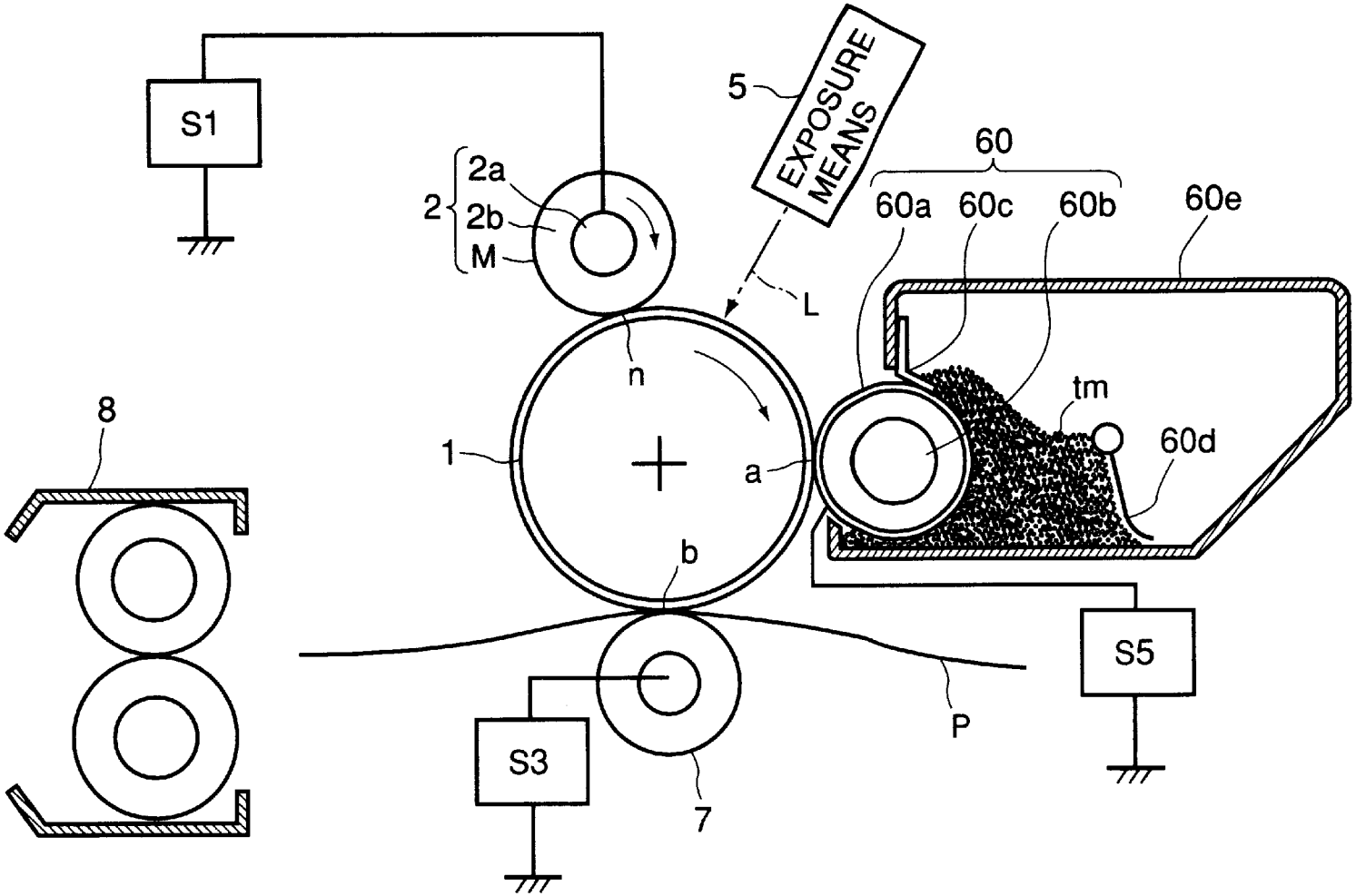
FIG. 8 schematically illustrates an organization of an electrophotographic apparatus according to Example 14.

FIG. 8 schematically illustrates another embodiment of the electrophotographic apparatus according to the present invention, wherein a toner recycle process (cleanerless system) is adopted. Referring to FIG. 8, differences from the embodiment of FIG. 6 are described.

<Overall Arrangement>

The electrophotographic apparatus does not include an independent charging or conductor particles-supplying means. Conductor particles are added as a portion of developer in mixture with a toner. As the toner is consumed by the development operation, the conductor particles are accumulated and supplied to the charging roller 2 via the photosensitive member 1. The electrophotographic apparatus includes a developing means 60 for developing an electrostatic latent image on an electrophotographic photosensitive member 1 at a developing position a. The developing means 60 contains therein a mixture tm comprising a developer (toner) t and conductor particles m.

The electrophotographic apparatus according to this embodiment adopts a toner recycle process wherein transfer residual toner remaining on the photosensitive member 1 after image transfer is not recovered by a separate cleaner (cleaning device) but is recovered temporarily by a charging roller 2 rotated in a counter-clockwise direction at a contact nip n with the photosensitive member 1. Further, as the residual toner is moved about the charging roller 2, the residual toner having a reverse charge having caused the transfer failure is charged to a normal polarity and is gradually set free to the photosensitive member 1 to reach the developing position a, where the residual toner is recovered and reutilized by the developing means while effecting the developing with the developer mixture tm.

<Developing Means>

The developing means 60 is a reversal development means using a mono-component magnetic toner (negatively chargeable toner) as the developer t and contains a mixture tm of the developer (toner) t and conductor particles m.

The developing means 60 includes a non-magnetic rotating developing sleeve 60*a*, as a developer-carrying member, enclosing therein a magnetic roller 60*b*, and also a developer vessel 60*e* containing therein the developer mixture tm. The developer mixture tm is stirred and pushed toward the developing sleeve 60*a* by the action of a stirring member 60*d* and is carried and conveyed by the rotating developing sleeve 60*a* to be formed into a layer having a controlled thickness by the action of a regulation blade 60*c* while the toner is provided with a prescribed charge.

The toner t (in mixture with conductor particles m) formed in a layer on the rotating developing sleeve 60*a* is conveyed to a developing position (developing region) a where the photosensitive member 1 and the sleeve 60*a* are disposed opposite to each other. For the development, the sleeve 60*a* is supplied with a developing bias voltage from a voltage supply S5.

In a specific example, an AC/DC-superposed bias voltage was applied to the sleeve 60*a*, so as to effect reverse development with the toner t of an electrostatic latent images on the photosensitive member 1.

<Toner>

The mono-component magnetic toner (developer) t is prepared by blending a binder resin, magnetic particles and a charge control agent, followed by melt-kneading of the blend, pulverization and classification, to form toner particles, and by blending the toner particles with external additives, such as a flowability improver. As mentioned above, the toner t is further blended with the conductor particles m to form the developer mixture tm. In a specific example the toner was formed in a weight-average particle size (D4) of 7 $\mu$m.

<Carried Amount and Coverage of Conductor Particles>

In this embodiment employing the toner recycle process, the toner is liable to soil the charging roller surface. The toner has a resistivity of at least $10^{13}$ ohm.cm as it is required to retain a triboelectric charge on its surface. Accordingly, if the charging roller is soiled with the toner, the resistivity of the conductor particles carried on the charging roller is increased to lower the charging performance. Even if the conductor particles per se have a low resistivity, the carried particles are caused to have an increased resistivity by the entrainment of the toner. The conductor particles are preferably carried at a rate of 0.1–100 mg/$cm^2$, and more preferably 0.1–10 mg/$cm^2$. In a specific example, the conductor particles were carried at a rate of 5 mg/$cm^2$. The lowering in charging performance due to the mixing of toner can be evaluated by measuring the resistivity of the carried particles. More specifically, the particles carried on the charging roller (inclusive of entrained residual toner and paper dust) in an actual operation may preferably have a resistivity of $10^{-1}$ to $10^{12}$ ohm.cm, and more preferably $10^{-1}$ to $10^{10}$ ohm.cm as measured according to the above described method.

In order to evaluate the effectively carried amount of the conductor particles in the charging position, a coverage with the conductor particles may be measured. The conductor particles are generally white and can be discriminated from the magnetic toner particles in black color. By observation through a microscope, an areal proportion of white regions may be measured as a coverage. The coverage with conductor particles may preferably be retained in the range of 0.2–1 on the charging roller as a coverage of 0.1 or below results in an insufficient charging performance even at an increased peripheral speed of the charging roller. In a specific example, the coverage was set at 0.6.

The carried amount of conductor particles may be basically controlled by the amount of the admixed conductor particles to the developer and can be also controlled, as desired, by abutting an elastic blade locally at a part of the circumference of the charging roller. The abutment of such a member has an effect of normalizing the triboelectric charge polarity of the toner, thereby affecting the amount of particles carried on the charging roller.

In a system like this embodiment including the developing means also as a means for supplying conductor particles, it is preferred that a smaller amount of conductor particles are transferred to a recording medium, such as paper, so as to leave a larger amount of conductor particles on the photosensitive member. The conductor particles may preferably be charged to a positive polarity. This is because in the reversal development system, the developer is localized at a light-potential part and the conductor particles are localized at a dark-potential part, so that the developer is selectively transferred to the transfer material at the transfer step to leave the conductor particles on the photosensitive member, which are supplied to the charging roller for stabilizing the charging performance.

EXAMPLES

Hereinbelow, the present invention will be described more specifically with reference to Examples and Comparative Examples wherein "parts" and "%" used for describing a relative amount of a component or a material are by weight unless specifically noted otherwise.

Examples 1 to 3

An aluminum cylinder of 30 mm in diameter and 260.5 mm in length, as a support, was coated by dipping with a coating liquid comprising a 5 wt. %-solution in methanol of a polyamide resin ("AMILAN CM 8000", available from Toray K. K.), followed by drying to form a 0.5 μm-thick undercoating layer.

Separately, a coating liquid for providing a charge generation layer was prepared by mixing 4 parts of oxytitanium phthalocyanine pigment represented by a formula below and characterized by strong peaks at Bragg angles (20±0.2 deg.) of 9.0 deg., 14.2 deg., 23.9 deg. and 27.1 deg. according to CuKα characteristic X-ray diffraction

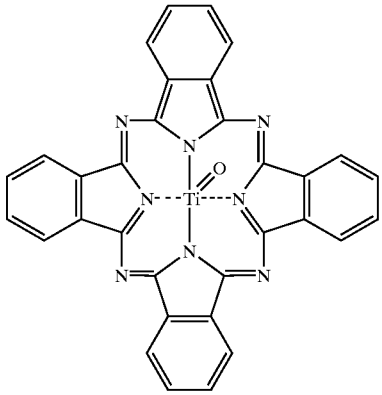

with 2 parts of polyvinyl butyral resin ("BX-1" available from Sekisui Kagaku Kogyo K. K.) and 80 parts of cyclohexanone, dispersing the mixture liquid for 4 hours in a sand mill containing 1 mm-dia. glass beads. The coating liquid was applied by dipping onto the undercoating layer and heated for drying at 105° C. for 10 min. to form a 0.2 μm-thick charge generation layer.

Then, a solution of 10 parts of a styryl compound of the following formula:

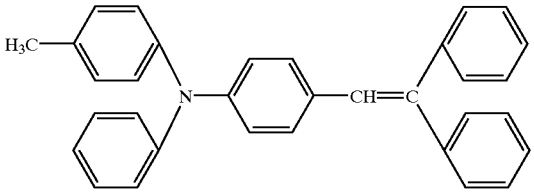

and 110 parts of bisphenol Z-type polycarbonate resin ("Z-200", available from Mitsubishi Gas Kagaku K. K. viscosity-average molecular weight (Mrv)=$2\times10^4$) in 100 parts of monochlorobenzene, was applied by dipping onto the charge generation layer and heated with hot air for drying at 105° C. for 1 hour to form a 20 μm-thick charge transport layer.

By repeating the above-mentioned steps, several photosensitive member half-products were prepared.

Separately, a coating liquid for providing a charge-injection layer was prepared as follows. First, 20 parts of antimony-doped tin oxide fine particles surface-treated with 7% of a fluorine-containing silane coupling agent represented by a formula below:

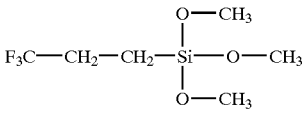

and 30 parts of antimony-doped tin oxide fine particles surface-treated with 20% of methylhydrogensilicone oil ("KF99", available from Shin-Etsu Silicone K. K.) were mixed with 150 parts of ethanol for 66 hours of dispersion in a sand mill to form a dispersion liquid, and then 20 parts of polytetrafluoro-ethylene fine particles (Dv=0.18 μm) was added thereto, followed by further 2 hours of dispersion. Then, 30 parts (as resin) of resole-type phenolic resin ("PL-4804", made by Gun'ei Kagaku Kogyo K. K., synthesized in the presence of an amine catalyst and having a polystyrene-equivalent molecular weight as measured by GPC (=Mw) of ca. 800) was dissolved in the above-formed dispersion liquid to form a coating liquid.

The coating liquid was applied by dipping onto the charge transport layer of each of the above prepared photosensitive member half-products but in different thicknesses, followed by drying with hot air at 145° C. for 1 hour to obtain photosensitive member samples having charge-injection layers in thickness of 1 μm, 2 μm, 3 μm, 4 μm, 7 μm and 10 μm, respectively, as measured by an instantaneous multi-photometer system ("MCPD-2000", available from Ohtsuka Denshi K.K.) utilizing interference of light adapted to measurement of thin film thicknesses (while such thicknesses may also be measured by direct observation of sections of layers on the photosensitive member through a scanning electron microscope (SEM), etc.). The coating liquid exhibited a good dispersibility of the particles therein and provided charge-injection layers exhibiting uniform film surfaces free from irregularity.

Each photosensitive member was subjected to measurement of elastic deformation percentages We (OCL) (%) and We (CTL) (%) in the above-described manner, i.e., by using a Fischer hardness meter of pressing a diamond indenter having a four-sided pyramid tip having an apex angle of 136 deg. at increasing loads until indentation depths reached 1 μm, followed by a gradual decrease of indentation loads. Each We (%) measurement was performed at arbitrarily selected 10 points for one sample, to obtain 8 measured values for the largest and smallest values were averaged to provide a We (%) value.

We (OCL) (%) was measured directly on each charge-injection layer on a photosensitive member, and We (CTL) (%) was measured with respect to a photosensitive layer after removal of a charge-injection layer formed thereon.

For the removal of a charge-injection layer, a drum polishing device (made by Canon K. K.) was used together with a lapping tape ("C2000", made by Fuji Shashin Film K. K.), but another means may also be used. However, the We (CTL) measurement should be performed after the charge-injection layer is completely removed while checking the charge-injection layer thickness or observing the surface state so as to avoid removal of the photosensitive layer therebelow. It has been however confirmed that even if the photosensitive layer is removed to some extent as a result of overpolishing, substantially identical values of We (CTL) (%) can be measure if the photosensitive layer retains at least 10 μm.

The thus-measured We (CTL) (%) was 42%, and We (OCL) (%) values at the 5 charge-injection layer thicknesses of 1 μm, 2 μm, 3 μm, 4 μm, 7 μm and 10 μm are shown in Table 1 together with those of Examples and Comparative Examples described hereinafter.

Among the 5 photosensitive member samples prepared above, those having charge-injection layer thicknesses of 1 μm (Example 1), 3 μm (Example 2) and 7 μm (Example 3), only after inspection with eyes of the photosensitive member surfaces (i.e., different from those having identical thicknesses but subjected to the above We (%) measurement), were subjected to evaluation of image forming performances according to a continuous image forming test on 10,000 sheets in an environment of 32° C./86% RH by using an electro-photographic apparatus as described below.

<Electrophotographic Apparatus 1 for Evaluation>

Each of the above-prepared three photosensitive members (Examples 1 to 3 having charge-injection layer thicknesses of 1 μm, 3 μm and 7 μm) was incorporated in an electrophotographic apparatus having an organization as shown in FIGS. 6 and 7 obtained by remodeling a commercially available laser beam printer ("LASER JET 4000", available from Hewlett-Packard Corp.) as described below.

A charging roller 2 was prepared by coating a core metal 2*a* with a medium resistivity layer 2*b* formed from urethane resin, electroconductive particles (carbon black), a vulcanizing agent and a foaming agent after polishing to provide a conductive elastic roller having a diameter of 12 mm and a length of 250 mm and exhibiting a resistance of 100 kilo-ohm.

Electroconductive zinc oxide particles having a resistivity of $10^6$ ohm.cm and an average particle size of 3 μm were used as conductor particles 3.

As shown in FIGS. 6 and 7, a regulation blade 4 was abutted against the charging roller 2 so as to retain the conductor particles 3 between the charging roller 2 and the regulation blade 4 at a prescribed rate to the charging roller 2.

The photosensitive member 1 was in the form of a 30 mm-dia. drum and rotated at a peripheral speed of 110 mm/sec in an indicated arrow direction. The charging roller 2 was rotated at ca. 150 rpm in a counter-clockwise direction with respect to the photosensitive member 1 so as to provide an identical peripheral speed in the opposite direction at the contact nip n. A DC voltage of −620 volts was applied to the core metal 2*b* of the charging roller 2.

As a result, the photosensitive member surface was charged to a potential (=−610 volts) almost identical to the DC voltage applied to the charging roller 2 in all Examples 1 to 3. Thus, in these Examples, injection charging was realized by the conductor particles 3 densely present at the contact nip between the charging roller 2 and the photosensitive member 1.

In all Examples 1 to 3, good images were obtained even after the continuous image formation on 10,000 sheets.

The results of the charged potentials and image forming performance evaluation are summarized in Table 1 together with those of Examples and Comparative Examples described below.

Examples 4 and 5

Two photosensitive members each having a 3 μm-thick charge-injection layer were prepared and evaluated in the same manner as in Example 2 except for using different grades of resole-type phenolic resins, i.e., "PL-4804" (having Mw=ca. 3000, Example 4) and "BKS-316" (made by Showa Kobunshi K. K., synthesized in the presence of an amine catalyst; Example 5).

Examples 6–8

Three photosensitive members each having a 3 μm-thick charge-injection layer were prepared and evaluated in the same manner as in Example 5 except for using increased amounts, i.e., 50 parts (Example 6), 100 parts (Example 7) and 150 parts (Example 8), respectively, as resins instead of the 30 parts (as resin) of the phenolic resin.

Example 9

A photosensitive member having a 3 μm-thick charge-injection layer was prepared and evaluated in the same manner as in Example 4 using the phenolic resin (Mw=ca. 3000) except for using a decreased amount of 15 parts (as resin) of the phenolic resin.

Examples 10–12

Three photosensitive members each having a 3 μm-thick charge-injection layer were prepared in the same manners as Examples 6–8, respectively, except for using a polycarbonate resin having an increased molecular weight (Mrv=$10^5$) instead of the polycarbonate resin (Mrv=$2\times10^4$) as the binder resin for the charge transport layer.

Example 13

A photosensitive member was prepared and evaluated in the same manner as in Example 9 having a 3 μm-thick charge-injection layer prepared by using 15 parts (as resin) of the phenolic resin except for using a polycarbonate resin having an increased molecular weight (Mrv=$10^5$) instead of the polycarbonate resin (Mrv=$2\times10^4$) as the binder resin for the charge transport layer.

The photosensitive members prepared in Examples 10–13 exhibited a higher elastic deformation percentage We (CTL) (%) of 43.1% which was higher by 1.1% than those of the other Examples.

Comparative Examples 1–3

Three photosensitive members having charge-injection layers in thicknesses of 1 μm, 3 μm and 7 μm, respectively, were prepared and evaluated in the same manner as in Examples 1–3, respectively, except that each charge-injection layer was prepared by using a coating liquid formed by using 100 parts of an acrylic resin represented by a formula shown below together with 6 parts of 2-methylthioxanthone (photopolymerization initiator) instead of the phenolic resin and curing a layer of the coating liquid by 30 sec. of photoirradiation at 800 mW/$cm^2$ with a high-pressure mercury lamp, followed by 100 min. of drying with hot air at 120° C.

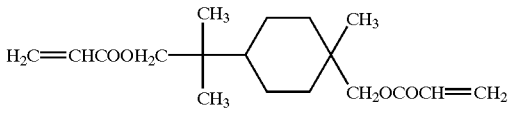

Comparative Example 4

A photosensitive member having a 3 μm-thick charge-injection layer was prepared and evaluated in the same manner as in Example 2 except for preparing the charge-injection layer formed of only resin by omitting the conductor particles and the polytetrafluoroethylene particles and using methylphenylpolysiloxane ("KF-50500CS", made by Shin-Etsu Silicone K. K.) instead of the phenolic resin.

Comparative Example 5

A photosensitive member having a 3 μm-thick charge-injection layer was prepared in the same manner as in Example 10 except that the charge-injection layer of only resin was prepared in the same manner as in Comparative Example 1.

The photosensitive members prepared in Comparative Examples 5–7 exhibited a higher elastic deformation percentage We (CTL) (%) of 43.1% which was higher by 1.1% than those of the other Comparative Examples.

Comparative Example 6

A photosensitive member having a 3 μm-thick charge-injection layer was prepared and evaluated in the same manner as in Example 10 except for preparing the charge-injection layer formed of only resin by omitting the conductor particles and the polytetrafluorooctylene particles and using methylphenylpolysiloxane ("KF-50500CS", made by Shin-Etsu Silicone K. K.) instead of the phenolic resin.

Examples 14–16

Three photosensitive members having charge-injection layers in thicknesses of 1 μm, 3 μm and 7 μm, respectively, were prepared and evaluated in the same manner as in Examples 1 to 3, except that each photosensitive member was incorporated and evaluated in the electrophotographic apparatus described with reference to FIG. 8 including toner recycle process (cleanerless system).

Examples 17 and 18

Two photosensitive members each having a 3 μm-thick charge-injection layers were prepared and evaluated in the same manner as in Example 15 except for using 100 parts and 150 parts, respectively, as resin of a different grade of phenolic resin ("PL-4084", having an increase molecular weight of Mw=ca. 3000) instead of 30 parts of the phenolic resin ("PL-4804", Mw=ca. 800).

Example 19

A photosensitive member having a 3 μm-thick charge-injection layer was prepared and evaluated in the same manner as in Example 15 except for using 15 parts (as resin) of another grade of phenolic resin ("BKS-316", made by Showa Kobunshi K. K., synthesized in the presence of an amine catalyst) instead of the 30 parts (as resin) of the phenolic resin ("PL-4084", Mw=ca. 800).

Comparative Examples 7–9

Three photosensitive members each having charge-injection layer in thicknesses of 1 μm, 3 μm and 7 μm respectively, prepared in the same manner as in Comparative Examples 1–3, were evaluated in the same manner as in Examples 14–16.

Comparative Example 10

A photosensitive member having a 3 μm-thick charge-injection layer was prepared and evaluated in the same manner as in Example 15 except for preparing the charge-injection layer formed of only resin by omitting the conductor particles and the polytetrafluorooctylene particles and using methylphenylpolysiloxane ("KF-50500CS", made by Shin-Etsu Silicone K. K.) instead of the phenolic resin.

Example 20

A photosensitive member having a 3 μm-thick charge-injection layer was prepared and evaluated in the same manner as in Example 2 except for applying an AC/DC superposed voltage of DC −620 volts plus AC peak-to-peak voltage Vpp of 200 volts (instead of DC −620 volts alone) to the charging roller 2.

Comparative Example 11

A photosensitive member having a 3 μm-thick charge-injection layer was prepared and evaluated in the same manner as in Example 2 except for using an electrophotographic apparatus obtained by remodeling the commercially available laser beam printer ("LASER JET 4000") so as to apply a DC voltage of −620 volts to the primary charging roller and remove the cleaning means.

Comparative Example 12

A photosensitive member having a 3 μm-thick charge-injection layer was prepared and evaluated in the same manner as in Comparative Example 11 except for applying an AC/DC superposed voltage of DC −620 volts plus AC peak-to-peak voltage Vpp of 200 volts (instead of DC −620 volts alone) to the primary charging roller.

Example 21

A photosensitive member having a 3 μm-thick charge-injection layer was prepared and evaluated in the same manner as in Example 2 except for using a resole-type phenolic resin ("Pli-O-Phen J325", made by Dai Nippon Ink Kagaku Kogyo K. K., synthesized in the presence of an ammonia catalyst solid matter content=70%).

Incidentally, a 10 μm-thick charge-injection layer prepared similarly exhibited Benard cells.

Further, the coating liquid for the charge-injection layer prepared in the above-described manner caused gelling 3 days after the preparation.

Comparative Example 13

A photosensitive member having a 4 μm-thick charge-injection layer was prepared in the same manner as in Example 2 except that the charge-injection layer was prepared by spraying onto the charge transport layer a coating liquid prepared by dispersing 100 parts of $Ta_2O_5$-doped tin oxide particles, 90 parts of resole-type phenolic resin ("Pli-O-Phen J-325", made by Dai Nippon Ink Kagaku Kogyo K. K., synthesized in the presence of an ammonia catalyst), and heating the coating liquid layer at 140° C. for 30 min.

Five photosensitive members prepared in similar manner but at different thicknesses of 1, 2, 3, 4, 7 and 10 μm, exhibited We (OCL) (%) values as shown in Table 1 which were lower than the range defined in the present invention. This is presumably because of factors, such as a lower solid matter content, a solvent having a higher boiling point, a lower curing temperature, a shorter curing time, compared with Example 21.

The charge-injection layers having thicknesses of 7 μm and 10 μm exhibited Behard cells. The coating liquid caused gelling 5 days after the preparation.

We (OCL) values and the results of evaluation for the above Examples and Comparative Examples are inclusively shown in the following Table 1.

TABLE 1

| | Limit values of We (OCL)(%) in formula (1) or (2) | | | | | | | | |
|---|---|---|---|---|---|---|---|---|---|
| Thickness d | 1 μm | 2 μm | 3 μm | 4 μm | 7 μm | 10 μm | | | |
| upper limit in (1) | 49.6 | 55.5 | 60.1 | 63.4 | 67.7 | 67.7 | | | |
| Lower limit | 41.3 | 40.6 | 39.9 | 39.2 | 37.0 | 34.9 | | | Images |
| upper limit in (2) | 45.9 | 49.4 | 52.3 | 54.8 | 59.2 | 59.2 | | | after |
| Example | Measured values of We (OCL) (%) | | | | | | Formula (1), satisfied? | Vd (V) | 10000 sheets |
| 1 | 43.2 | 45.4 | 47.2 | 48.6 | 50.1 | 50.1 | Yes | −610 | good |
| 2 | 43.2 | 45.4 | 47.2 | 48.6 | 50.1 | 50.1 | Yes | −610 | good |
| 3 | 43.2 | 45.4 | 47.2 | 48.6 | 50.1 | 50.1 | Yes | −610 | good |
| 4 | 42.2 | 44.1 | 46.3 | 47.2 | 49.5 | 49.6 | Yes | −610 | good |
| 5 | 43.6 | 45.7 | 47.6 | 48.7 | 50.4 | 50.4 | Yes | −610 | good |
| 6 | 45.2 | 47.3 | 49.5 | 52.3 | 56.4 | 56.4 | Yes | −600 | good |
| 7 | 45.9 | 49.4 | 52.3 | 54.8 | 59.2 | 59.2 | Yes | −590 | good |
| 8 | 49.6 | 55.5 | 60.1 | 63.4 | 67.7 | 67.7 | Yes | −580 | slight fog |
| 9 | 41.3 | 40.6 | 39.9 | 39.2 | 37.0 | 37.0 | Yes | −615 | good |
| 10 | 46.3 | 48.4 | 50.6 | 53.4 | 57.5 | 57.5 | Yes | −600 | good |
| 11 | 47.0 | 50.5 | 53.4 | 55.9 | 60.3 | 60.3 | Yes | −590 | good |
| 12 | 50.7 | 56.6 | 61.2 | 64.5 | 68.8 | 68.8 | Yes | −580 | slight fog |
| 13 | 42.4 | 41.7 | 41.0 | 40.3 | 38.1 | 38.1 | Yes | −615 | good |
| 14 | 43.2 | 45.4 | 47.2 | 48.6 | 50.1 | 50.1 | Yes | −610 | good |
| 15 | 43.2 | 45.4 | 47.2 | 48.6 | 50.1 | 50.1 | Yes | −610 | good |
| 16 | 43.2 | 45.4 | 47.2 | 48.6 | 50.1 | 50.1 | Yes | −610 | good |
| 17 | 45.9 | 49.4 | 52.3 | 54.8 | 59.2 | 59.2 | Yes | −600 | good |
| 18 | 49.6 | 55.5 | 60.1 | 63.4 | 67.7 | 67.7 | Yes | −590 | slight fog |
| 19 | 41.3 | 40.6 | 39.9 | 39.2 | 37.0 | 37.0 | Yes | −615 | good |
| 20 | 43.2 | 45.4 | 47.2 | 48.6 | 50.1 | 50.1 | Yes | −610 | good |
| 21 | 41.8 | 41.0 | 40.6 | 39.2 | 37.4 | 36.5 | Yes | −610 | good |
| Comp. 1 | 51.1 | 56.5 | 61.5 | 64.2 | 68.5 | 68.5 | No | −610 | fog |
| Comp. 2 | 51.1 | 56.5 | 61.5 | 64.2 | 68.5 | 68.5 | No | −610 | fog |
| Comp. 3 | 51.1 | 56.5 | 61.5 | 64.2 | 68.5 | 68.5 | No | −610 | fog |
| Comp. 4 | 40.8 | 40.3 | 39.2 | 38.1 | 36.5 | 36.5 | No | −550 | streaks |
| Comp. 5 | 52.2 | 57.6 | 62.6 | 65.3 | 69.4 | 69.4 | No | −600 | fog |
| Comp. 6 | 41.9 | 41.4 | 40.3 | 39.2 | 37.6 | 37.6 | No | −550 | streaks |
| Comp. 7 | 51.1 | 56.5 | 61.5 | 64.2 | 68.5 | 68.5 | No | −610 | fog |
| Comp. 8 | 51.1 | 56.5 | 61.5 | 64.2 | 68.5 | 68.5 | No | −610 | fog |
| Comp. 9 | 51.1 | 56.5 | 61.5 | 64.2 | 68.5 | 68.5 | No | −610 | fog |
| Comp. 10 | 40.8 | 40.3 | 39.2 | 38.1 | 36.5 | 36.5 | No | −550 | streaks |
| Comp. 11 | 43.2 | 45.4 | 47.2 | 48.6 | 50.1 | 50.1 | No | −150 | no images |
| Comp. 12 | 43.2 | 45.4 | 47.2 | 48.6 | 50.1 | 50.1 | No | −200 | no images |
| Comp. 13 | 40.9 | 40.1 | 38.9 | 37.6 | 36.0 | 35.0 | No | −600 | streaks |

As described above, according to the present invention, it is possible to provide an electrophotographic apparatus and a process cartridge therefor realizing an effective injection charging system and capable of stably providing high-quality images free from fog peculiar to the charging system even after continuous image formation in a high humidity environment, while exhibiting high durability against the occurrence of scars.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic apparatus, comprising: an electrophotographic photosensitive member and a charging means, wherein the charging means comprises a conductor particle-carrying member having an electroconductive and elastic surface, and conductor particles having a particle size of 10 mm–10 μm and carried on the carrying member so as to be disposed in contact with the photosensitive member, thereby directly injecting charges to the photosensitive member to charge the photosensitive member, and the photosensitive member comprises a photosensitive layer and a charge injection layer as a surface layer disposed in this order on a support, the charge-injection layer having a thickness d (μm) and an elastic deformation percentage We (OCL) (%) satisfying a relationship of formula (1) below with an elastic deformation percentage We (CTL) (%) of the photosensitive layer:

$$-0.71\times d+We(CTL)\leqq We(OCL)\leqq 0.03\times d^3-0.89\times d^2+8.43\times d+We(CTL) \quad (1).$$

2. An electrophotographic apparatus according to claim 1, wherein d (μm), We(OCL) (%) and We(CTL) (%) further satisfy the following formula (2):

$$-0.71\times d+We(CTL)\leqq We(OCL)\leqq -0.247\times d^2+4.19\times d+We(CTL) \quad (2).$$

3. An electrophotographic apparatus according to claim 1, wherein the charge-injection layer comprises a cured resin.

4. An electrophotographic apparatus according to claim 3, wherein the cured resin comprises a resole-type phenolic resin.

5. An electrophotographic apparatus according to claim 4, wherein the resole-type phenolic resin has been synthesized in the presence of an amine compound catalyst.

6. An electrophotographic apparatus according to claim 1, wherein the charge-injection layer contains electroconductive particles.

7. An electrophotographic apparatus according to claim 6, wherein the charge-injection layer contains lubricating particles.

8. An electrophotographic apparatus according to claim 1, wherein the charge-injection layer has a thickness of 1–7 μm.

9. An electrophotographic apparatus according to claim 1, wherein the conductor particles have a resistivity of at most $10^{10}$ ohm.cm.

10. An electrophotographic apparatus according to claim 1, wherein the conductor particles exhibit a coverage of 0.2–1.0 on the conductive particle carrying member.

11. An electrophotographic apparatus according to claim 1, wherein the conductor particle-carrying member and the photosensitive member move in mutually opposite directions at a contact position therebetween.

12. An electrophotographic apparatus according to claim 1, wherein the conductor particle-carrying member has a resistivity of $10^4$–$10^7$ ohm.

13. An electrophotographic apparatus according to claim 1, wherein the conductor particle-carrying member has an Asker C hardness of 25–50 deg.

14. An electrophotographic apparatus according to claim 1, wherein the conductor particle-carrying member has a surface layer comprising an elastic foam.

15. A process cartridge, comprising: an electrophotographic photosensitive member and charging means integrally supported to form a unit detachably mountable to an electrophotographic apparatus, wherein the charging means comprises a conductor particle-carrying member having an electroconductive and elastic surface, and conductor particles having a particle size of 10 nm–10 μm and carried on the carrying member so as to be disposed in contact with the photosensitive member, thereby directly injecting charges to the photosensitive member to charge the photosensitive member, and the photosensitive member comprises a photosensitive layer and a charge injection layer as a surface layer disposed in this order on a support, the charge-injection layer having a thickness d (μm) and an elastic deformation percentage We (OCL) (%) satisfying a relationship of formula (1) below with an elastic deformation percentage We (CTL) (%) of the photosensitive layer:

$$-0.71\times d+We(CTL)\leqq We(OCL)\leqq 0.03\times d^3-0.89\times d^2+8.43\times d+We(CTL) \quad (1).$$

* * * * *

UNITED STATES PATENT AND TRADEMARK OFFICE

CERTIFICATE OF CORRECTION

PATENT NO. : 6,697,591 B2 
DATED : February 24, 2004
INVENTOR(S) : Yosuke Morikawa et al.

It is certified that error appears in the above-identified patent and that said Letters Patent is hereby corrected as shown below:

Column 1,
Line 26, "liable" should read -- liable to --.
Line 61, "in respects of" should read -- with respect to --.

Column 3,
Line 5, "|Vd÷Vdc" should read -- |Vd|÷|Vdc| --.

Column 4,
Line 1, "÷" should read -- ≈ -- and "|Vdc-Vth|" should read -- |Vdc| - |Vth| --.
Line 37, "a" should read -- an --.

Column 5,
Line 66, "illustrate some detail" should read -- illustrates some details --.

Column 6,
Line 23, "-0.247x$d_2$" should read -- 0.247x$d^2$ --.

Column 9,
Line 4, "$(OCH_3)3$" should read -- $(OCH_3)_3$ --.

Column 12,
Line 6, "alcohol." should read -- alcohol, --.
Line 56, "thickens" should read -- thickness --.

Column 14,
Line 23, "attainably" should read -- attainable --.
Line 55, "$10^{4-107}$ohm." should read -- $10^4$-$10^7$ohm. --.

Column 16,
Line 39, "images" should read -- image --.

Column 17,
Line 65, "(20±0.2 deg.)" should read -- 2θ ±0.2 deg.) --.

Column 19,
Line 45, "measure" should read -- measured --.

UNITED STATES PATENT AND TRADEMARK OFFICE

CERTIFICATE OF CORRECTION

PATENT NO. : 6,697,591 B2
DATED : February 24, 2004
INVENTOR(S) : Yosuke Morikawa et al.

It is certified that error appears in the above-identified patent and that said Letters Patent is hereby corrected as shown below:

Column 24,
Line 1, "in" should read -- in a --.
Line 13, "Behard" should read -- Benard --.

Column 25,
Line 15, "10mm-10$\mu$m" should read -- 10nm-10$\mu$m --.

Signed and Sealed this

Third Day of May, 2005

JON W. DUDAS
*Director of the United States Patent and Trademark Office*